US009894434B2

(12) United States Patent
Rollow, IV et al.

(10) Patent No.: US 9,894,434 B2
(45) Date of Patent: Feb. 13, 2018

(54) CONFERENCE SYSTEM WITH A MICROPHONE ARRAY SYSTEM AND A METHOD OF SPEECH ACQUISITION IN A CONFERENCE SYSTEM

(71) Applicant: Sennheiser electronic GmbH & Co. KG, Wedemark (DE)

(72) Inventors: J. Douglas Rollow, IV, San Francisco, CA (US); Lance Reichert, San Francisco, CA (US); Daniel Voss, Hannover (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 0 days.

(21) Appl. No.: 14/959,387

(22) Filed: Dec. 4, 2015

(65) Prior Publication Data

US 2017/0164101 A1 Jun. 8, 2017

(51) Int. Cl.

| | |
|---|---|
| ***H04R 3/00*** | (2006.01) |
| ***H04R 1/40*** | (2006.01) |
| ***H04R 3/04*** | (2006.01) |

(52) U.S. Cl.

CPC ..... *H04R 1/406* (2013.01); *H04R 3/005* (2013.01); *H04R 3/04* (2013.01); *H04R 2201/401* (2013.01); *H04R 2201/405* (2013.01); *H04R 2430/23* (2013.01)

(58) Field of Classification Search

CPC ..... H04R 1/406; H04R 3/005; H04R 3/04; H04R 2201/401; H04R 2201/405; H04R 2430/23

USPC ..... 381/92

See application file for complete search history.

(56) References Cited

U.S. PATENT DOCUMENTS

| | | | | |
|---|---|---|---|---|
| 5,335,011 | A * | 8/1994 | Addeo | H04N 7/15 348/14.1 |
| 5,602,962 | A | 2/1997 | Kellerman | |
| 6,731,334 | B1 | 5/2004 | Maeng et al. | |
| 2008/0247567 | A1 | 10/2008 | Kjolerbakken et al. | |

(Continued)

FOREIGN PATENT DOCUMENTS

| | | |
|---|---|---|
| EP | 1 439 526 | 7/2004 |
| EP | 1 651 001 | 4/2006 |
| EP | 2 197 219 | 6/2010 |

OTHER PUBLICATIONS

International Search Report for Application No. PCT/EP2016/079720 dated May 29, 2017.

(Continued)

*Primary Examiner* — Vivian Chin
*Assistant Examiner* — Ammar Hamid
(74) *Attorney, Agent, or Firm* — Haug Partners LLP

(57) ABSTRACT

A conference system including a microphone array unit having a plurality of microphone capsules arranged in or on a board mountable on or in a ceiling of a conference room. The microphone array unit has a steerable beam and a maximum detection angle range. The conference system further includes a processing unit which is configured to receive the output signals of the microphone capsules and to steer the beam based on the received output signal of the microphone array unit. The processing unit is configured to control the microphone array to limit the detection angle range to exclude at least one predetermined exclusion sector in which a noise source is located.

5 Claims, 10 Drawing Sheets

(56) References Cited

U.S. PATENT DOCUMENTS

| | | | | |
|---|---|---|---|---|
| 2011/0164761 | A1* | 7/2011 | McCowan | H04R 3/005 381/92 |
| 2012/0076316 | A1 | 3/2012 | Zhu et al. | |
| 2013/0034241 | A1 | 2/2013 | Pandey et al. | |
| 2015/0055797 | A1 | 2/2015 | Nguyen et al. | |
| 2016/0323668 | A1* | 11/2016 | Abraham | H04R 31/00 |

OTHER PUBLICATIONS

Written Opinion for Application No. PCT/EP2016/079720 dated May 29, 2017.
International Search Report for Application No. PCT/EP2016/079720 dated Feb. 17, 2017.

* cited by examiner

CONFERENCE SYSTEM WITH A MICROPHONE ARRAY SYSTEM AND A METHOD OF SPEECH ACQUISITION IN A CONFERENCE SYSTEM

FIELD OF THE INVENTION

The invention relates to a conference system as well as a method of speech acquisition in a conference system.

In a conference system, the speech signal of one or more participants, typically located in a conference room, must be acquired such that it can be transmitted to remote participants or for local replay, recording or other processing.

SUMMARY OF THE INVENTION

FIG. 1A shows a schematic representation of a first conference environment as known from the prior art. The participants of the conference are sitting at a table 1020 and a microphone 1110 is arranged in front of each participant 1010. The conference room 1001 may be equipped with some disturbing sound source 1200 as depicted on the right side. This may be some kind of fan cooled device like a projector or some other technical device producing noise. In many cases those noise sources are permanently installed at a certain place in the room 1001.

Each microphone 1100 may have a suitable directivity pattern, e.g. cardioid and is directed to the mouth of the corresponding participant 1010. This arrangement enables predominant acquisition of the participants' 1010 speech and reduced acquisition of disturbing noise. The microphone signals from the different participants 1010 may be summed together and can be transmitted to remote participants. A disadvantage of this solution is the microphone 1100 requiring space on the table 1020, thereby restricting the participants work space. Furthermore for proper speech acquisition the participants 1010 have to stay at their seat. If a participant 1010 walks around in the room 1001, e.g. for using a whiteboard for additional explanation, this arrangement leads to degraded speech acquisition results.

FIG. 1B shows a schematic representation of a conference environment according to the prior art. Instead of using one installed microphone for each participant, one or more microphones 1110 are arranged for acquiring sound from the whole room 1001. Therefore, the microphone 1110 may have an omnidirectional directivity pattern. It may either be located on the conference table 1020 or e.g. ceiling mounted above the table 1020 as shown in FIG. 1B. The advantage of this arrangement is the free space on the table 1020. Furthermore, the participants 1010 may walk around in the room 1001 and as long as they stay close to the microphone 1110, the speech acquisition quality remains at a certain level. On the other hand, in this arrangement disturbing noise is always fully included in the acquired audio signal. Furthermore, the omnidirectional directivity pattern results in noticeable signal to noise level degradation at increased distance from the speaker to the microphone.

FIG. 1C shows a schematic representation of a further conference environment according to the prior art. Here, each participant 1010 is wearing a head mounted microphone 1120. This enables a predominant acquisition of the participants' speech and reduced acquisition of disturbing noise, thereby providing the benefits of the solution from FIG. 1A. At the same time the space on the table 1020 remains free and the participants 1010 can walk around in the room 1001 as known from the solution of FIG. 1B. A significant disadvantage of this third solution consist in a protracted setup procedure for equipping every participant with a microphone and for connecting the microphones to the conference system.

US 2008/0247567 A1 shows a two-dimensional microphone array for creating an audio beam pointing to a given direction.

U.S. Pat. No. 6,731,334 B1 shows a microphone array used for tracking the position of a speaking person for steering a camera.

It's an object of the invention to provide a conference system that enables enhanced freedom of the participants at improved speech acquisition and reduced setup effort.

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

Figure 1A:
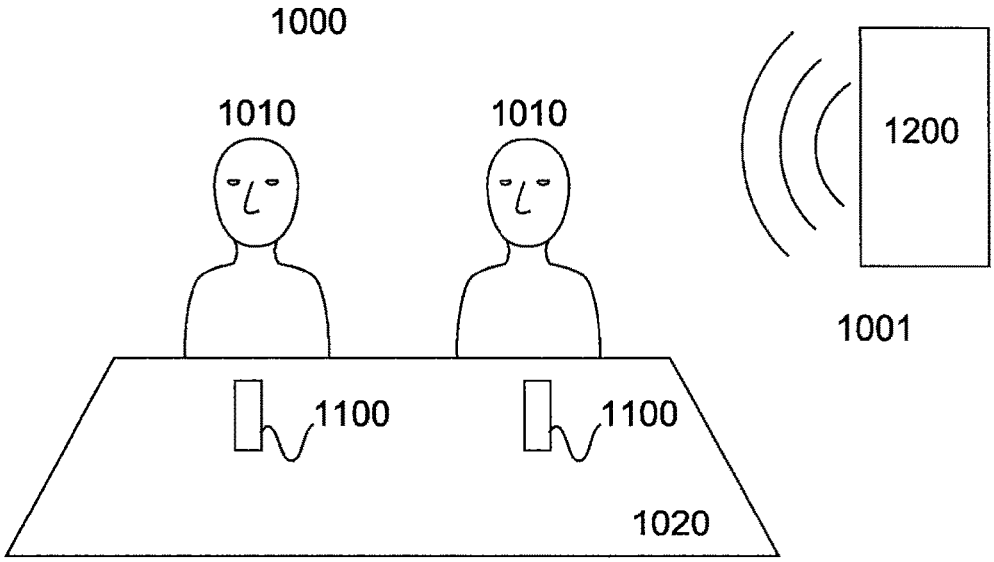
Fig. 1A (Prior Art)
FIG. 1A shows a schematic representation of a first conference environment as known from the prior art.
Figure 1B:
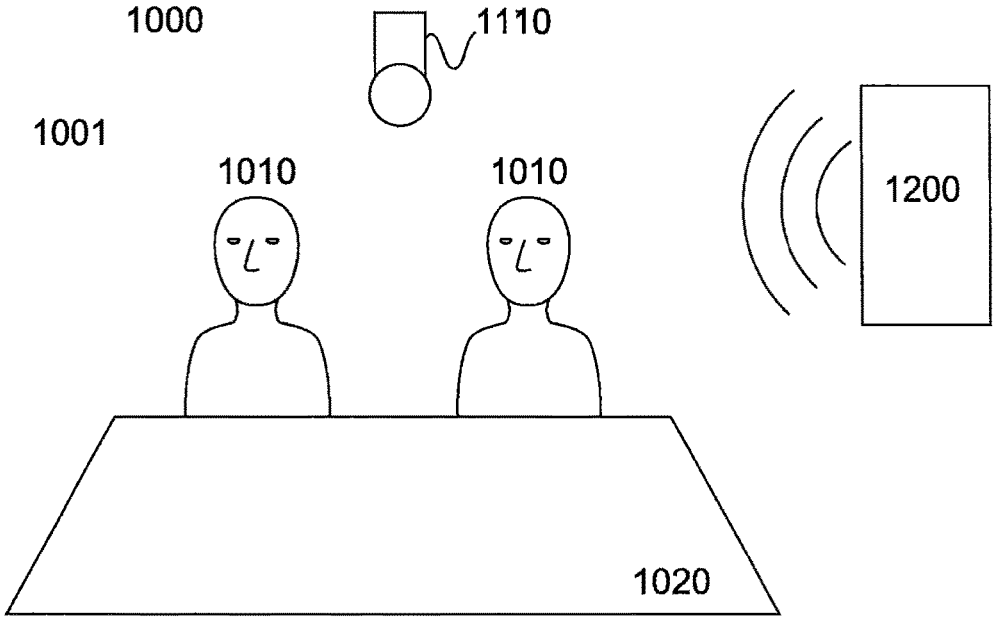
Fig. 1B (Prior Art)
FIG. 1B shows a schematic representation of a conference environment according to the prior art.
Figure 1C:
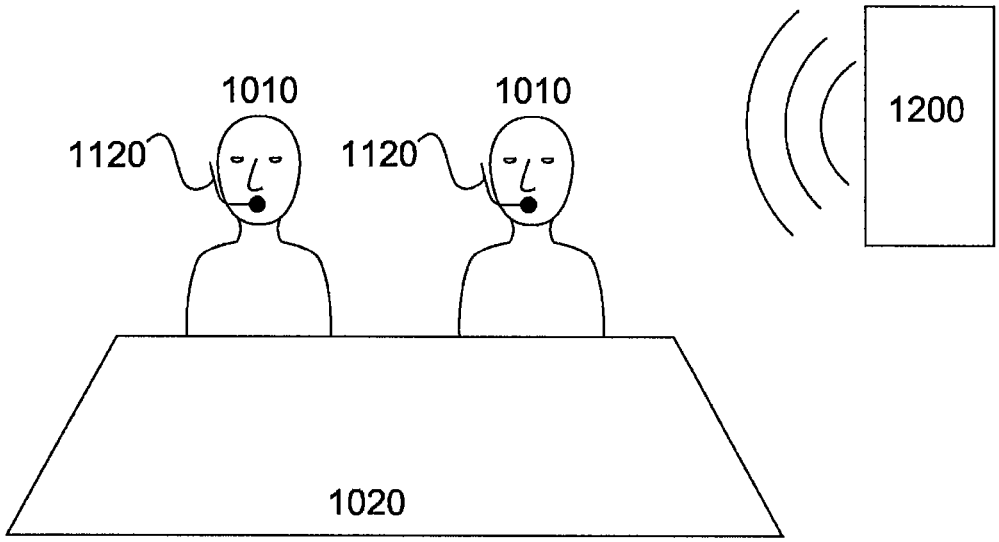
Fig. 1C (Prior Art)
FIG. 1C shows a schematic representation of a further conference environment according to the prior art.
Figure 2:
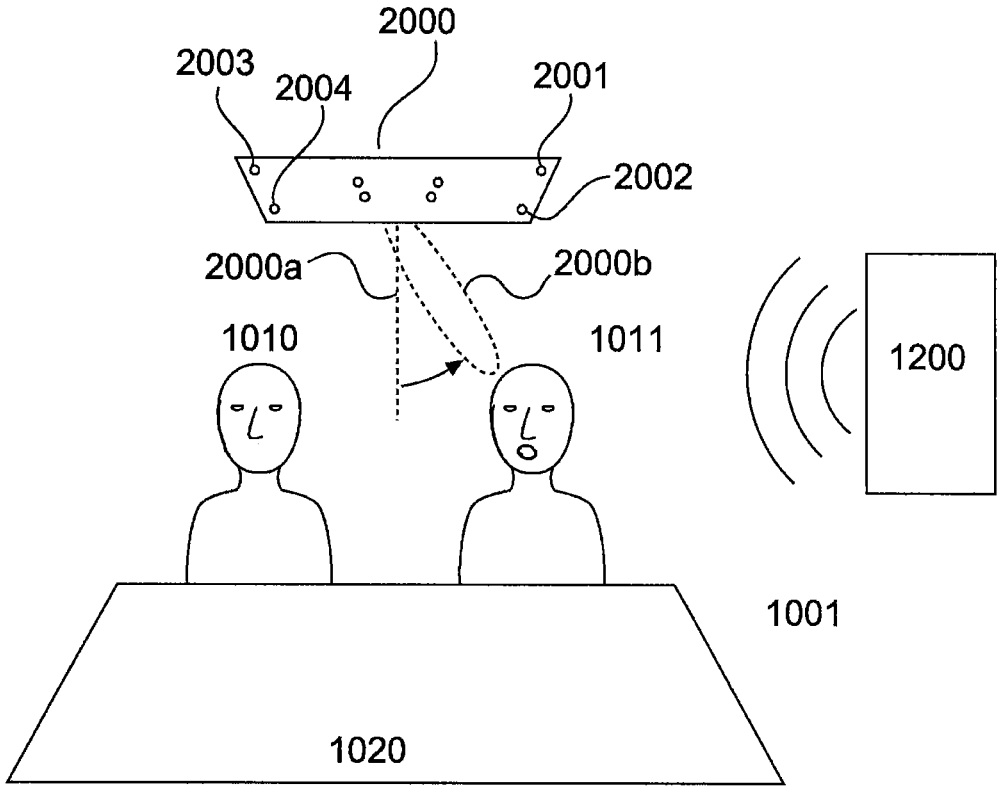
FIG. 2 shows a schematic representation of a conference room with a microphone array according to the invention.

FIG. 2 shows a schematic representation of a conference room with a microphone array according to the invention. A microphone array 2000 can be mounted above the conference table 1020 or rather above the participants 1010, 1011.

The microphone array unit 2000 is thus preferably ceiling mounted. The microphone array 2000 comprises a plurality of microphone capsules 2001-2004 preferably arranged in a two dimensional configuration. The microphone array has an axis 2000*a* and can have a beam 2000*b*.

The audio signals acquired by the microphone capsules 2001-2004 are fed to a processing unit 2400 of the microphone array unit 2000. Based on the output signals of the microphone capsules, the processing unit 2400 identifies the direction (a spherical angle relating to the microphone array; this may include a polar angle and an azimuth angle; optionally a radial distance) in which a speaking person is located. The processing unit 2400 then executes an audio beam 2000*b* forming based on the microphone capsule signals for predominantly acquiring sound coming from the direction as identified.

The speaking person direction can periodically be re-identified and the microphone beam direction 2000*b* can be continuously adjusted accordingly. The whole system can be preinstalled in a conference room and preconfigured so that no certain setup procedure is needed at the start of a conference for preparing the speech acquisition. At the same time the speaking person tracing enables a predominant acquisition of the participants' speech and reduced acquisition of disturbing noise. Furthermore the space on the table remains free and the participants can walk around in the room at remaining speech acquisition quality.

Figure 3:
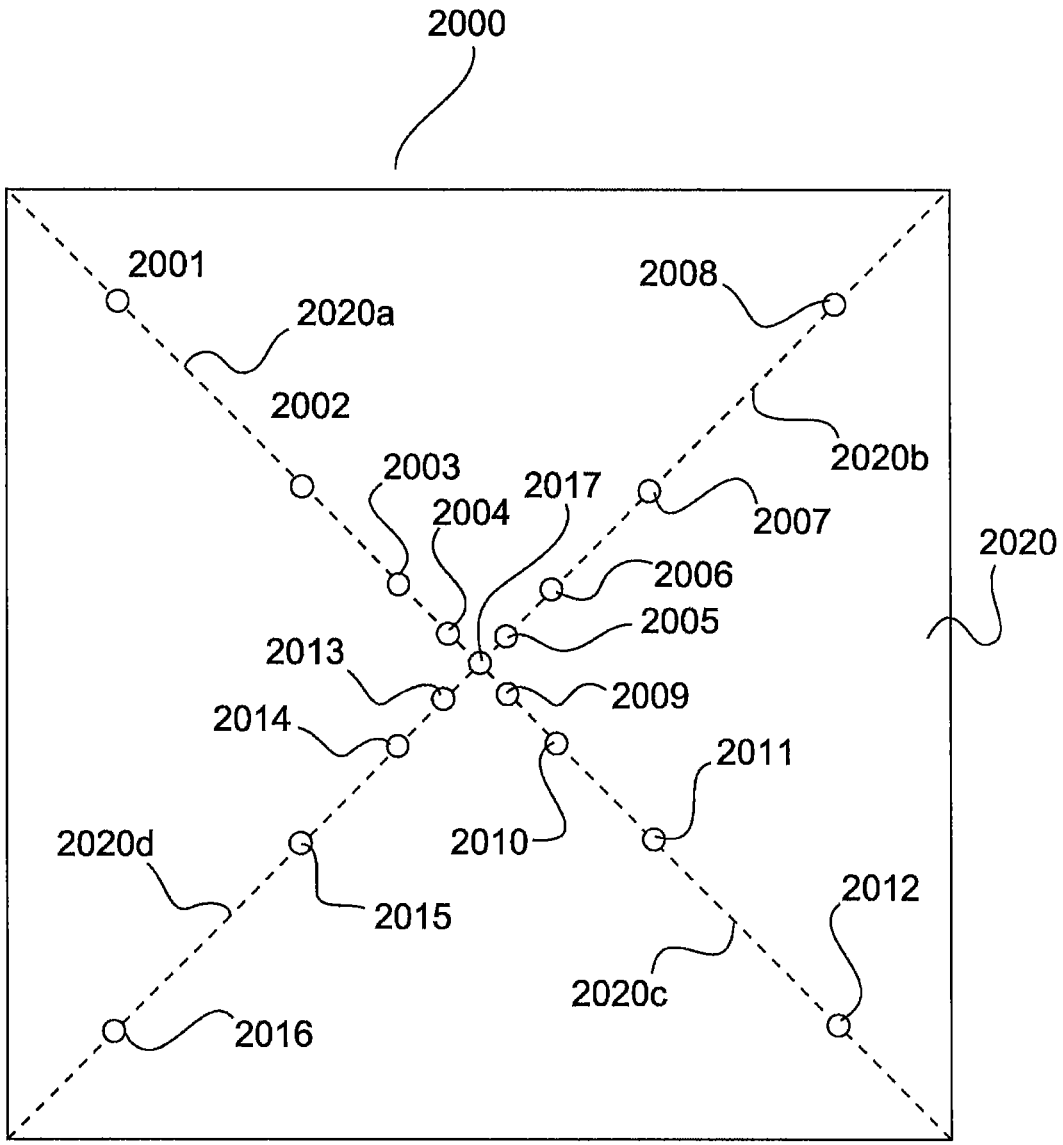
FIG. 3 shows a schematic representation of a microphone array according to the invention.

FIG. 3 shows a schematic representation of a microphone array unit according to the invention. The microphone array 2000 consists of a plurality of microphone capsules 2001-2007 and a (flat) carrier board 2020. The carrier board 2020 features a closed plane surface, preferably larger than 30 cm×30 cm in size. The capsules 2001-2017 are preferably arranged in a two dimensional configuration on one side of the surface in close distance to the surface (<3 cm distance between the capsule entrance and the surface; optionally the capsules 2001-2017 are inserted into the carrier board 2020 for enabling zero distance). The carrier board 2020 is closed in such a way that sound can reach the capsules from the surface side, but sound is blocked away from the capsules from the opposite side by the closed carrier board. This is advantageous as it prevents the capsules from acquiring reflected sound coming from a direction opposite to the surface side. Furthermore the surface provides a 6 dB pressure gain due to the reflection at the surface and thus increased signal to noise ratio.

The carrier board 2020 can optionally have a square shape. Preferably it is mounted to the ceiling in a conference room in a way that the surface is arranged in a horizontal orientation. On the surface directing down from the ceiling the microphone capsules are arranged. FIG. 3 shows a plane view of the microphone surface side of the carrier board (from the direction facing the room).

Here, the capsules are arranged on the diagonals of the square shape. There are four connection lines 2020*a*-2020*d*, each starting at the middle point of the square and ending at one of the four edges of the square. Along each of those four lines 2020*a*-2020*d* a number of microphone capsules 2001-2017 is arranged in a common distance pattern. Starting at the middle point the distance between two neighboring capsules along the line is increasing with increasing distance from the middle point. Preferably, the distance pattern represents a logarithmic function with the distance to the middle point as argument and the distance between two neighboring capsules as function value. Optionally a number of microphones which are placed close to the center have an equidistant linear spacing, resulting in an overall linear-logarithmic distribution of microphone capsules.

The outermost capsule (close to the edge) 2001, 2008, 2016, 2012 on each connection line still keeps a distance to the edge of the square shape (at least the same distance as the distance between the two innermost capsules). This enables the carrier board to also block away reflected sound from the outermost capsules and reduces artifacts due to edge diffraction if the carrier board is not flush mounted into the ceiling.

Optionally the microphone array further comprises a cover for covering the microphone surface side of the carrier board and the microphone capsules. The cover preferably is designed to be acoustically transparent, so that the cover does not have a substantial impact on the sound reaching the microphone capsules.

Preferably all microphone capsules are of the same type, so that they feature the same frequency response and the same directivity pattern. The preferred directivity pattern for the microphone capsules 2001-2017 is omnidirectional as this provides as close as possible a sound incident angle independent frequency response for the individual microphone capsules. However, other directivity patterns are possible.

Specifically cardioid pattern microphone capsules can be used to achieve better directivity, especially at low frequencies. The capsules are preferably arranged mechanically parallel to each other in the sense that the directivity pattern of the capsules all point into the same direction. This is advantageous as it enables the same frequency response for all capsules at a given sound incidence direction, especially with respect to the phase response.

In situations where the microphone system is not flush mounted in the ceiling, further optional designs are possible.

Figure 4:
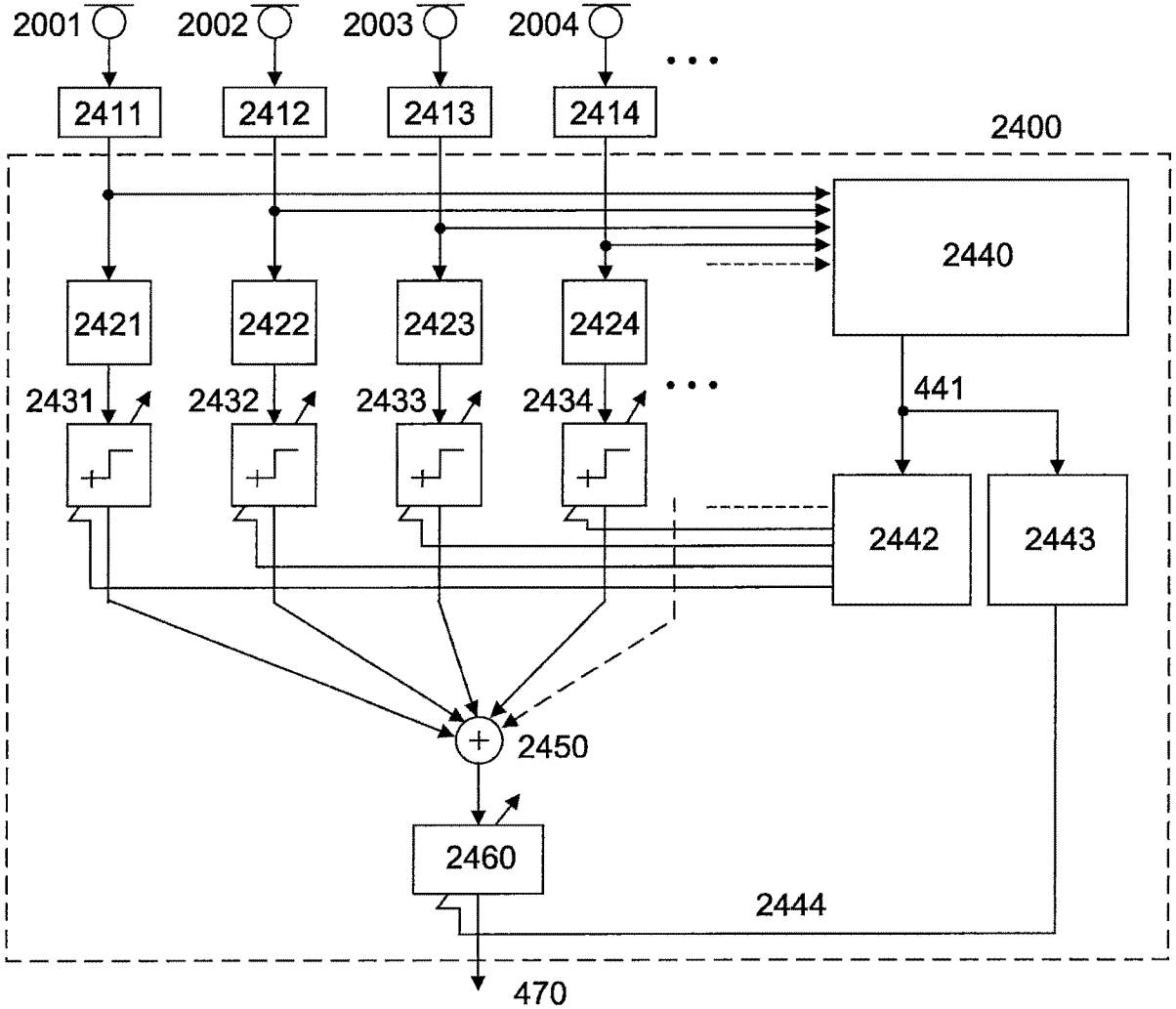
FIG. 4 shows a block diagram of a processing unit of the microphone array according to the invention.

FIG. 4 shows a block diagram of a processing unit of the microphone array unit according to the invention. The audio signals acquired by the microphone capsules 2001-2017 are fed to a processing unit 2400. On top of FIG. 4 only four microphone capsules 2001-2004 are depicted. They stand as placeholder for the complete plurality of microphone capsules of the microphone array and a corresponding signal path for each capsule is provided in the processing unit 2400. The audio signals acquired by the capsules 2001-2004 are each fed to a corresponding analog/digital converter 2411-2414. Inside the processing unit 2400, the digital audio signals from the converters 2411-2414 are provided to a direction recognition unit 2440. The direction recognition unit 2440 identifies the direction in which a speaking person is located as seen from the microphone array 2000 and outputs this information as direction signal 2441. The direction information 2441 may e.g. be provided in Cartesian coordinates or in spherical coordinates including an elevation angle and an azimuth angle. Furthermore the distance to the speaking person may be provided as well.

The processing unit 2400 furthermore comprises individual filters 2421-2424 for each microphone signal. The output of each individual filters 2421-2424 is fed to an individual delay unit 2431-2434 for individually adding an adjustable delay to each of those signals. The outputs of all those delay units 2431-2434 are summed together in a summing unit 2450. The output of the summing unit 2450 is fed to a frequency response correction filter 2460. The output signal of the frequency response correction filter 2460 represents the overall output signal 2470 of the processing unit 2400. This is the signal representing a speaking person's voice signal coming from the identified direction.

Directing the audio beam to the direction as identified by the direction recognition unit 2440 in the embodiment of FIG. 4 can optionally be implemented in a "delay and sum" approach by the delay units 2431-2434. The processing unit 2400 therefore includes a delay control unit 2442 for receiving the direction information 2441 and for converting this into delay values for the delay units 2431-2434. The delay units 2431-2434 are configured to receive those delay values and to adjust their delay time accordingly.

The processing unit 2400 furthermore comprises a correction control unit 2443. The correction control unit 2443 receives the direction information 2441 from the direction recognition unit 2440 and converts it into a correction control signal 2444. The correction control signal 2444 is used to adjust the frequency response correction filter 2460. The frequency response correction filter 2460 can be performed as an adjustable equalizing unit. The setting of this equalizing unit is based on the finding that the frequency response as observed from the speaking person's voice signal to the output of the summing unit 2450 is dependent to the direction the audio beam 2000*b* is directed to. Therefore the frequency response correction filter 2460 is configured to compensate deviations from a desired amplitude frequency response by a filter 2460 having an inverted amplitude frequency response.

The position or direction recognition unit 2440 detects the position of audio sources by processing the digitized signals of at least two of the microphone capsules as depicted in FIG. 4. This task can be achieved by several algorithms. Preferably the SRP-PHAT (Steered Response Power with PHAse Transform) algorithm is used, as known from prior art.

When a microphone array with a conventional Delay and Sum Beamformer (DSB) is successively steered at points in space by adjusting its steering delays, the output power of the Beamformer can be used as measure where a source is located. The steered response power (SRP) algorithm performs this task by calculating generalized cross correlations (GCC) between pairs of input signals and comparing them against a table of expected time difference of arrival (TDOA) values. If the signals of two microphones are practically time delayed versions of each other, which will be the case for two microphones picking up the direct path of a sound source in the far field, their GCC will have a distinctive peak at the position corresponding to the TDOA of the two signals and it will be close to zero for all other positions. SRP uses this property to calculate a score by summing the GCCs of a multitude of microphone pairs at the positions of expected TDOAs, corresponding to a certain position in space. By successively repeating this summation over several points in space that are part of a pre-defined search grid, a SRP score is gathered for each point in space. The position with the highest SRP score is considered as the sound source position.

Figure 5:
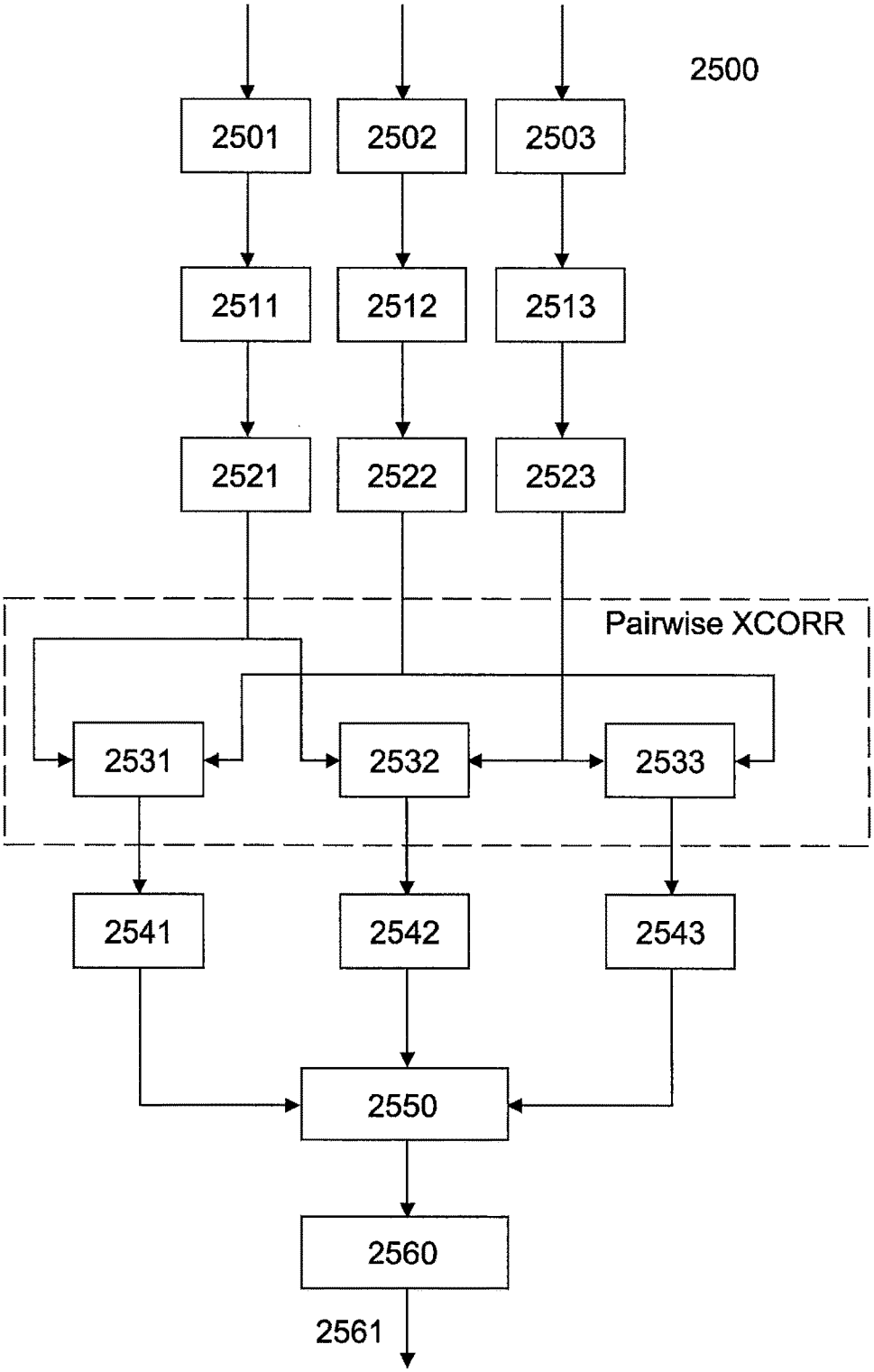
FIG. 5 shows the functional structure of the SRP-PHAT algorithm as implemented in the microphone system.

FIG. 5 shows the functional structure of the SRP-PHAT algorithm as implemented in the microphone array unit. At the top only three input signals are shown that stand as placeholders for the plurality of input signals fed to the algorithm. The cross correlation can be performed in the frequency domain. Therefore blocks of digital audio data from a plurality of inputs are each multiplied by an appropriate window 2501-2503 to avoid artifacts and transformed into the frequency domain 2511-2513. The block length directly influences the detection performance. Longer blocks achieve better detection accuracy of position-stationary sources, while shorter blocks allow for more accurate detection of moving sources and less delay. Preferably the block length is set to values, so that each part of spoken words can be detected fast enough while still being accurate in position. Thus preferably a block length of about 20-100 ms is used.

Afterwards the phase transform 2521-2523 and pairwise cross-correlation of signals 2531-2533 is performed before transforming the signals into the time domain again 2541-2543. These GCCs are then fed into the scoring unit 2550. The scoring unit computes a score for each point in space on a pre-defined search grid. The position in space that achieves the highest score is considered to be the sound source position.

By using a phase transform weighting for the GCCs, the algorithm can be made more robust against reflections, diffuse noise sources and head orientation. In the frequency domain the phase transform as performed in the units 2521-2523 divides each frequency bin with its amplitude, leaving only phase information. In other words the amplitudes are set to 1 for all frequency bins.

The SRP-PHAT algorithm as described above and known from prior art has some disadvantages that are improved in the context of this invention.

In a typical SRP-PHAT scenario the signals of all microphone capsules of an array will be used as inputs to the SRP-PHAT algorithm, all possible pairs of these inputs will be used to calculate GCCs and the search grid will be densely discretizing the space around the microphone array. All this leads to very high amounts of processing power required for the SRP-PHAT algorithm.

According to an aspect of the invention, a couple of techniques are introduced to reduce the processing power needed without sacrificing for detection precision. In contrast to using the signals of all microphone capsules and all possible microphone pairs, preferably a set of microphones can be chosen as inputs to the algorithm or particular microphone pairs can be chosen to calculate GCCs of. By choosing microphone pairs that give good discrimination of points in space, the processing power can be reduced while keeping a high amount of detection precision.

As the microphone system according to the invention only requires a look direction to point to a source, it is further not desirable to discretize the whole space around the microphone array into a search grid, as distance information is not necessarily needed. If a hemisphere with a radius much larger than the distance between the microphone capsules used for the GCC pairs is used, it is possible to detect the direction of a source very precisely, while at the same time reducing the processing power significantly, as only a hemisphere search grid is to be evaluated. Furthermore the search grid is independent from room size and geometry and risk of ambiguous search grid positions e.g. if a search grid point would be located outside of the room. Therefore, this solution is also advantageous to prior art solutions to reduce the processing power like coarse to fine grid refinement, where first a coarse search grid is evaluated to find a coarse source position and afterwards the area around the detected source position will be searched with a finer grid to find the exact source position.

It can be desirable to also have distance information of the source, in order to e.g. adapt the beamwidth to the distance of the source to avoid a too narrow beam for sources close to the array or in order to adjust the output gain or EQ according to the distance of the source.

Figure 6A:
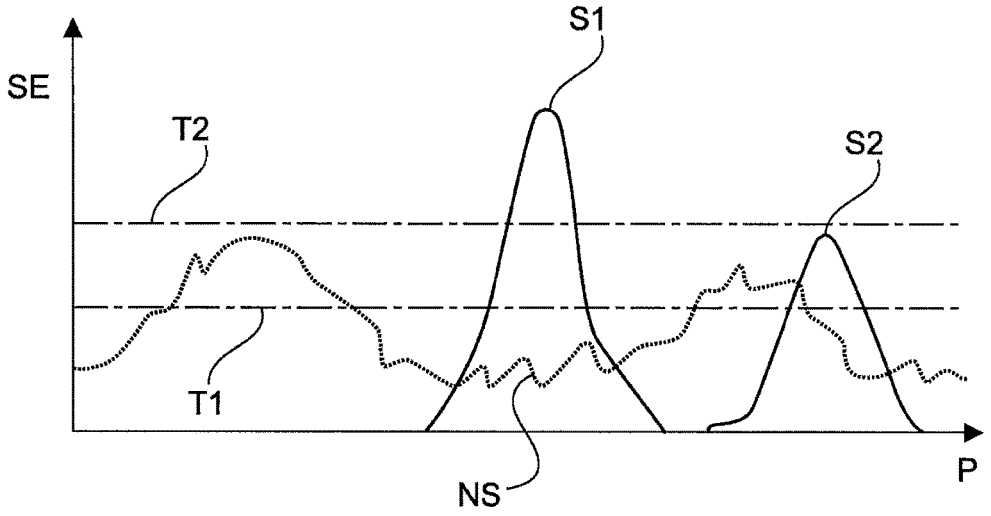
FIG. 6A shows a graph indicating a relation between a sound energy and a position.

Besides of significantly reducing the required processing power of typical SRP-PHAT implementations, the robustness against disturbing noise sources has been improved by a set of measures. If there is no person speaking in the vicinity of the microphone system and the only signals picked up are noise or silence, the SRP-PHAT algorithm will either detect a noise source as source position or especially in the case of diffuse noises or silence, quasi randomly detect a "source" anywhere on the search grid. This either leads to predominant acquisition of noise or audible audio artifacts due to a beam randomly pointing at different positions in space with each block of audio. It is known from prior art that this problem can be solved to some extent by computing the input power of at least one of the microphone capsules and to only steer a beam if the input power is above a certain threshold. The disadvantage of this method is that the threshold has to be adjusted very carefully depending on the noise floor of the room and the expected input power of a speaking person. This requires interaction with the user or at least time and effort during installation. This behavior is depicted in FIG. 6 A. Setting the sound energy threshold to a first threshold T1 results in noise being picked up, while the stricter threshold setting of a second threshold T2 misses a second source S2. Furthermore input power computation requires some CPU usage, which is usually a limiting factor for automatically steered microphone array systems and thus needs to be saved wherever possible.

Figure 6B:
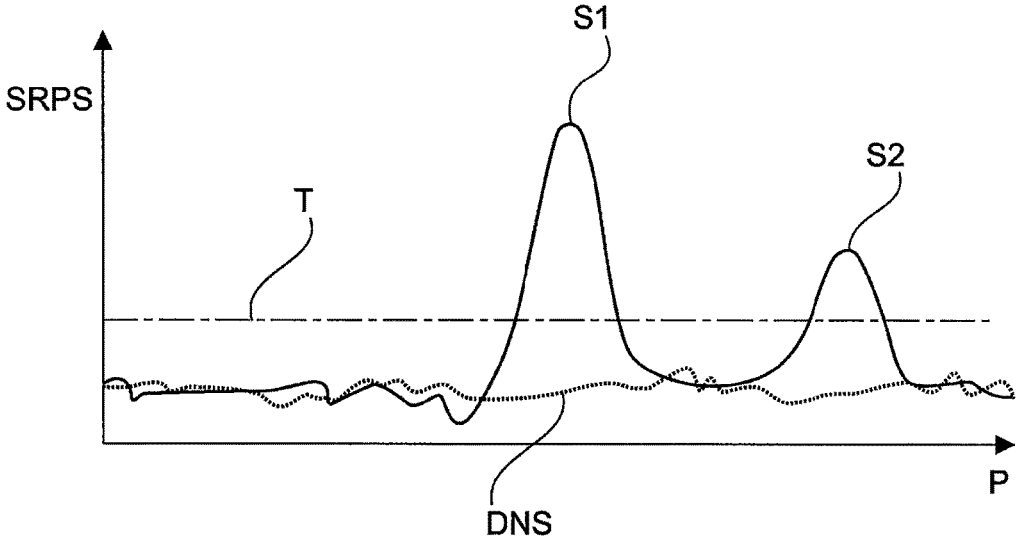
FIG. 6B shows a graph indicating a relation between a sound energy and a position.

The invention overcomes this problem by using the SRP-PHAT score that is already computed for the source detection as a threshold metric (SRP-threshold) instead or in addition to the input power. The SRP-PHAT algorithm is insensitive to reverberation and other noise sources with a diffuse character. In addition most noise sources as e.g. air conditioning systems have a diffuse character while sources to be detected by the system usually have a strong direct or at least reflected sound path. Thus most noise sources will produce rather low SRP-PHAT scores, while a speaking person will produce much higher scores. This is mostly independent of the room and installation situation and therefore no significant installation effort and no user interaction is required, while at the same time a speaking person will be detected and diffuse noise sources will not be detected by the system. As soon as a block of input signals achieves a SRP-PHAT score of less than the threshold, the system can e.g. be muted or the beam can be kept at the last valid position that gave a maximum SRP-PHAT score above the threshold. This avoids audio artifacts and detection of unwanted noise sources. The advantage over a sound energy threshold is depicted in FIG. 6B. Mostly diffuse noise sources produce a very low SRP score that is far below the SRP score of sources to be detected, even if they are rather subtle as "Source 2".

Thus this gated SRP-PHAT algorithm is robust against diffuse noise sources without the need of tedious setup and/or control by the user.

However, noise sources with a non-diffuse character that are present at the same or higher sound energy level as the wanted signal of a speaking person, might still be detected by the gated SRP-PHAT algorithm. Although the phase transform will result in frequency bins with uniform gain, a source with high sound energy will still dominate the phase of the systems input signals and thus lead to predominant detection of such sources. These noise sources can for example be projectors mounted closely to the microphone system or sound reproduction devices used to play back the audio signal of a remote location in a conference scenario. Another part of the invention is to make use of the predefined search grid of the SRP-PHAT algorithm to avoid detection of such noise sources. If areas are excluded from the search grid, these areas are hidden for the algorithm and no SRP-PHAT score will be computed for these areas. Therefore no noise sources situated in such a hidden area can be detected by the algorithm. Especially in combination with the introduced SRP-threshold this is a very powerful solution to make the system robust against noise sources.

Figure 7A:
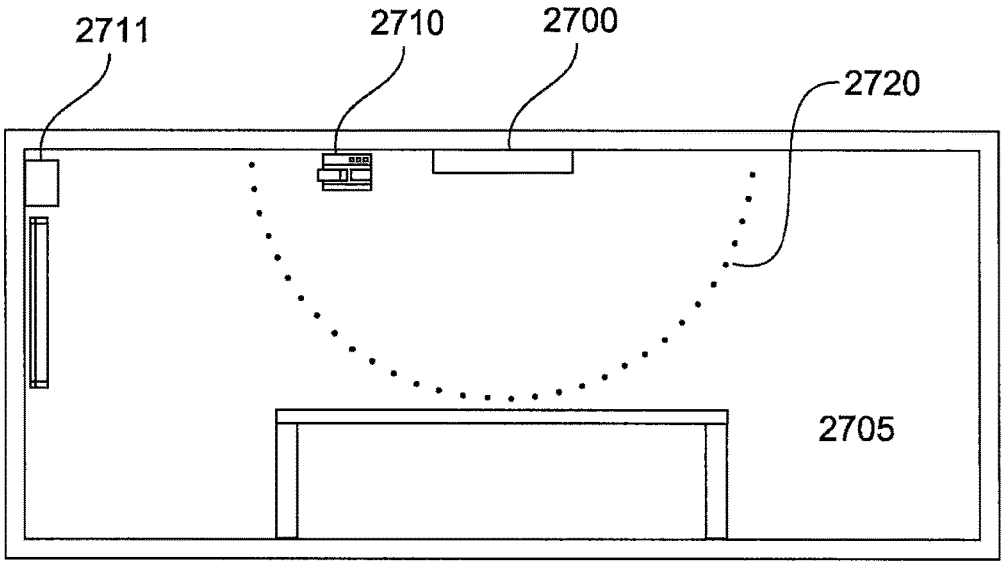
FIG. 7A shows a schematic representation of a conference room according to an example.
Figure 7B:
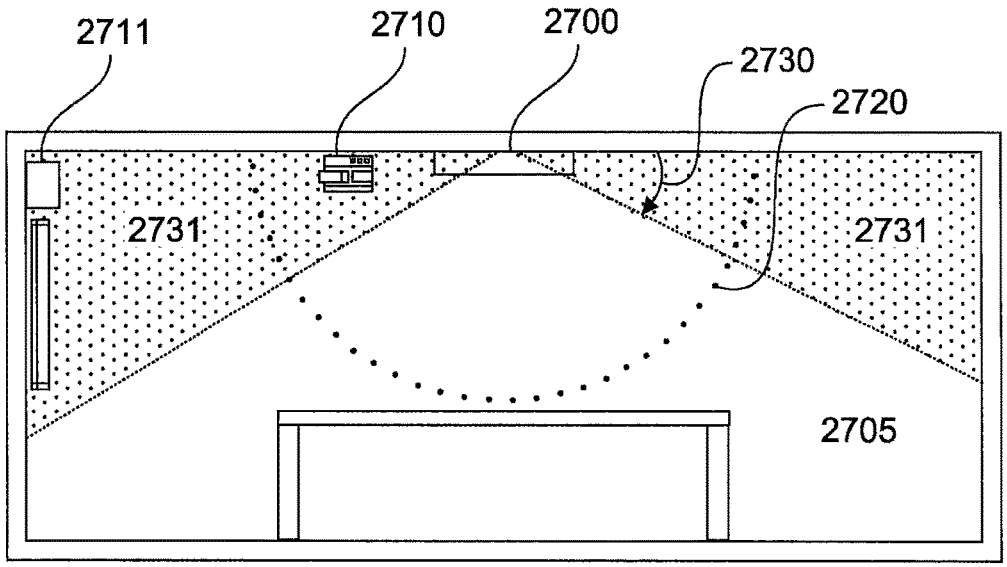
FIG. 7B shows a schematic representation of a conference room according to the invention.

FIG. 7A shows a schematic representation of a conference room according to an example and FIG. 7B shows a schematic representation of a conference room according to the invention.

FIG. 7B explanatory shows the exclusion of detection areas of the microphone system 2700 in a room 2705 by defining an angle 2730 that creates an exclusion sector 2731 where no search grid points 2720 are located, compared to an unrestrained search grid shown in FIG. 7A. Disturbing sources are typically located either under the ceiling, as a projector 2710 or on elevated positions at the walls of the room, as sound reproduction devices 2711. Thus these noise sources will be inside of the exclusion sector and will not be detected by the system.

The exclusion of a sector of the hemispherical search grid is the preferred solution as it covers most noise sources without the need of defining each noise sources position. This is an easy way to hide noise sources with directional sound radiation while at the same time ensure detection of speaking persons. Furthermore it is possible to leave out specific areas where a disturbing noise source is located.

Figure 8:
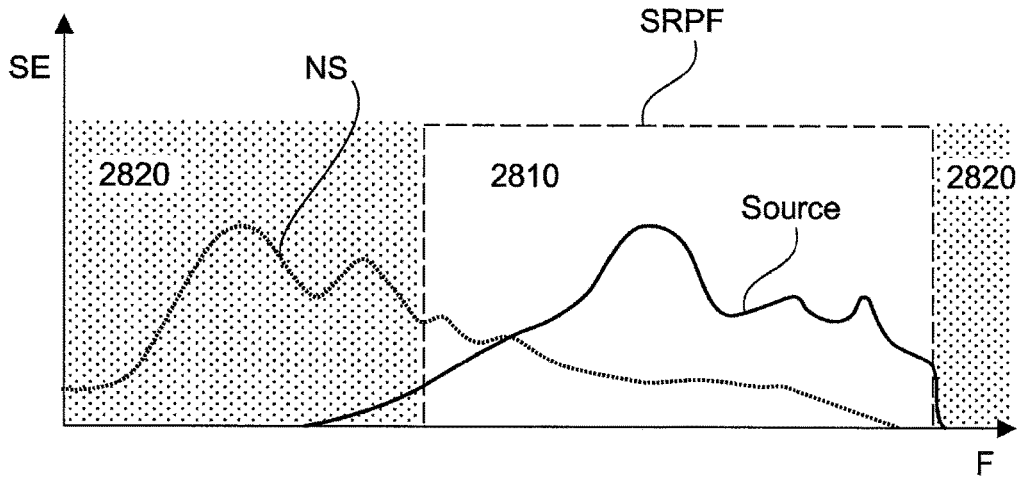
FIG. 8 shows a graph indicating a relation between a spectral energy SE and the frequency F.

FIG. 8 shows a graph indicating a relation between a spectral energy SE and the frequency F.

Another part of the invention solves the problem that appears if the exclusion of certain areas is not feasible e.g. if noise sources and speaking persons are located very close to each other. Many disturbing noise sources have most of their sound energy in certain frequency ranges, as depicted in FIG. 8. In such a case a disturbing noise source NS can be excluded from the source detection algorithm by masking certain frequency ranges 2820 in the SRP-PHAT algorithm by setting the appropriate frequency bins to zero and only keeping information in the frequency band where most source frequency information is located 2810. This is performed in the units 2521-2523. This is especially useful for low frequency noise sources.

But even taken alone this technique is very powerful to reduce the chance of noise sources being detected by the source recognition algorithm. Dominant noise sources with a comparably narrow frequency band can be suppressed by excluding the appropriate frequency band from the SRP frequencies that are used for source detection. Broadband low Frequency noises can also be suppressed very well, as speech has a very wide frequency range and the source detection algorithms as presented works very robust even when only making use of higher frequencies.

Combining the above techniques allows for a manual or automated setup process, where noise sources are detected by the algorithm and either successively removed from the search grid, masked in the frequency range and/or hidden by locally applying a higher SRP-threshold.

SRP-PHAT detects a source for each frame of audio input data, independently from sources previously detected. This characteristic allows the detected source to suddenly change its position in space. This is a desired behavior if there are two sources reciprocally active shortly after each other and allows instant detection of each source. However, sudden changes of the source position might cause audible audio artifacts if the array is steered directly using the detected source positions, especially in situations where e.g. two sources are concurrently active. Furthermore it is not desirable to detect transient noise sources such as placing a coffee cup on a conference table or a coughing person. At the same time these noises cannot be tackled by the features described before.

The source detection unit makes use of different smoothing techniques in order to ensure an output that is free from audible artifacts caused by a rapidly steered beam and robust against transient noise sources while at the same time keeping the system fast enough to acquire speech signals without loss of intelligibility.

The signals captured by a multitude or array of microphones can be processed such that the output signal reflects predominant sound acquisition from a certain look direction while not being sensitive to sound sources of other directions not being the look direction. The resulting directivity response is called the beampattern the directivity around the look direction is called beam and the processing done in order to form the beam is the beamforming.

One way to process the microphone signals to achieve a beam is a Delay-and-sum beamformer. It sums all the microphone's signals after applying individual delays for the signal captured by each microphone.

Figure 9A:
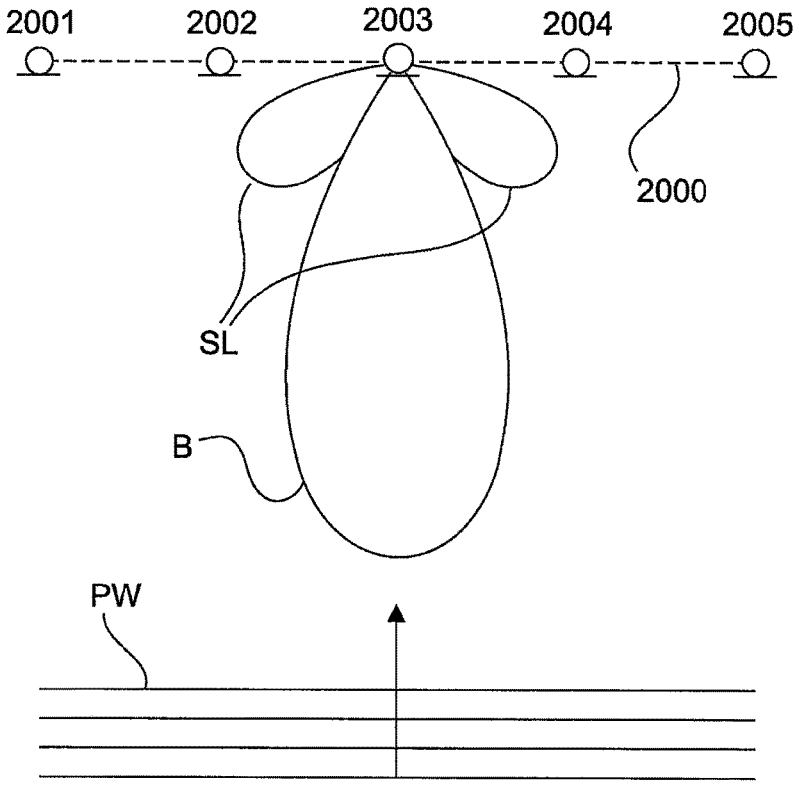
FIG. 9*a* shows a linear microphone array and audio sources in the far-field.
Figure 9B:
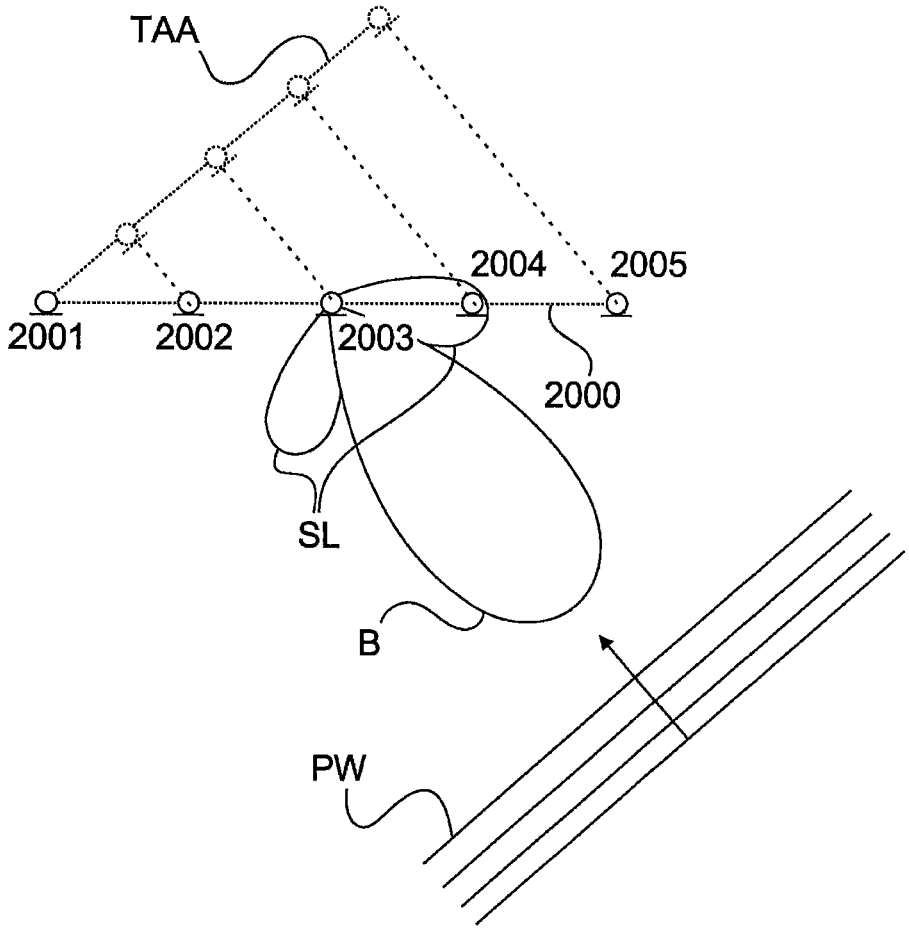
FIG. 9*b* shows a linear microphone and a plane wavefront from audio sources in the far-field.

FIG. 9*a* shows a linear microphone array and audio sources in the far-field. FIG. 9*b* shows a linear microphone and a plane wavefront from audio sources in the far-field. For a linear array as depicted in FIG. 9*a* and sources in the far-field, where a plane wave PW front can be assumed, the array 2000 has a beam B perpendicular to the array, originating from the center of the array (broadside configuration), if the microphone signal delays are all equal. By changing the individual delays in a way that the delayed microphone signals from a plane wave front of a source's direction sum with constructive interference, the beam can be steered. At the same time other directions will be insensitive due to destructive interference. This is shown in FIG. 9*b*, where the time aligned array TAA illustrates the delay of each microphone capsule in order to reconstruct the broadside configuration for the incoming plane wavefront.

A Delay-and-sum beamformer (DSB) has several drawbacks. Its directivity for low frequencies is limited by the maximum length of the array, as the array needs to be large in comparison to the wavelength in order to be effective. On the other hand the beam will be very narrow for high frequencies and thus introduces varying high frequency response if the beam is not precisely pointed to the source and possibly unwanted sound signature. Furthermore spatial aliasing will lead to sidelobes at higher frequencies depending on the microphone spacing. Thus the design of an array geometry is contrary, as good directivity for low frequencies requires a physically large array, while suppression of spatial aliasing requires the individual microphone capsules to be spaced as dense as possible.

In a filter-and-sum beamformer (FSB) the individual microphone signals are not just delayed and summed but, more generally, filtered with a transfer function and then summed. A filter-and-sum beamformer allows for more advanced processing to overcome some of the disadvantages of a simple delay-and-sum beamforner.

Figure 10:
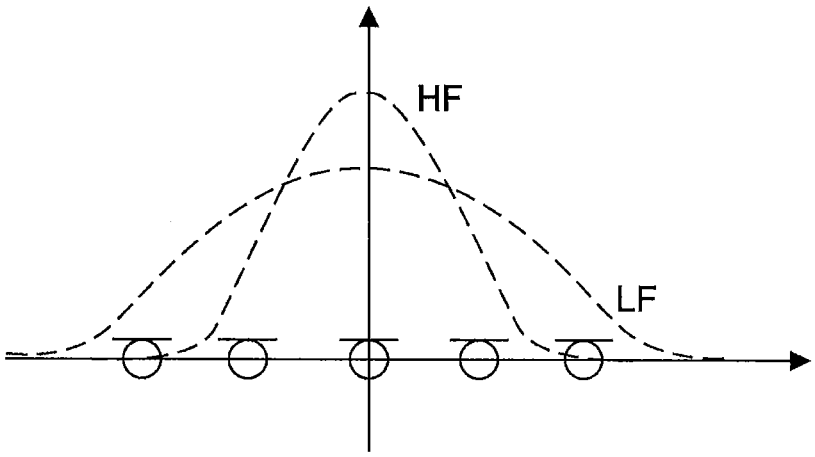
FIG. 10 shows a graph depicting a relation of a frequency and a length of the array.

FIG. 10 shows a graph depicting a relation of a frequency and a length of the array.

By constraining the outer microphone signals to lower frequencies using shading filters, the effective array length of the array can be made frequency dependent as shown in FIG. 10. By keeping the ratio of effective array length and frequency constant, the beam pattern will be held constant as well. If the directivity is held constant above a broad frequency band, the problem of a too narrow beam can be avoided and such an implementation is called frequency-invariant-beamformer (FIB).

Both DSB and FIB are non-optimal beamformers. The "Minimum Variance Distortionless Response" (MVDR) technique tries to optimize the directivity by finding filters that optimize the SNR ratio of a source at a given position and a given noise source distribution with given constraints that limit noise. This enables better low frequency directivity but requires a computationally expensive iterative search for optimized filter parameters.

The microphone system comprises a multitude of techniques to further overcome the drawbacks of the prior art.

In a FIB as known from prior art, the shading filters need to be calculated depending on the look direction of the array. The reason is that the projected length of the array is changing with the sound incidence angle, as can be seen in FIG. 9*b*, where the time-aligned array is shorter than the physical array.

Figure 11:
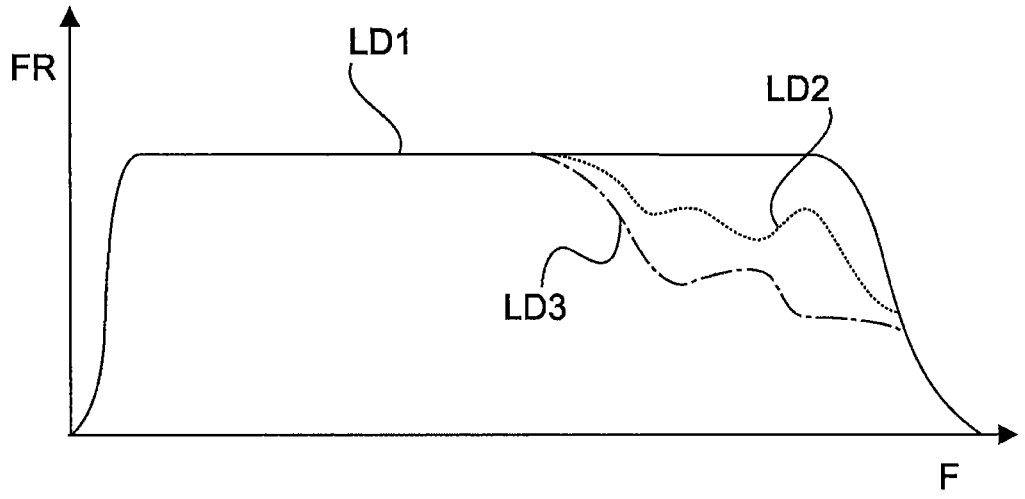
FIG. 11 shows a graph depicting a relation between the frequency response FR and the frequency F.

FIG. 11 shows a graph depicting a relation between the frequency response FR and the frequency F.

These shading filters however will be rather long and need to be computed or stored for each look direction of the array. The invention comprises a technique to use the advantages of a FIB while keeping the complexity very low by calculating fixed shading filters computed for the broadside configuration and factoring out the delays as known from a DSB, depending on the look direction. In this case the shading filters can be implemented with rather short FIR filters in contrast to rather long FIR filters in a typical FIB. Furthermore factoring out the delays gives the advantage that several beams can be calculated very easily as the shading filters need to be calculated once. Only the delays need to be adjusted for each beam depending on its look direction, which can be done without significant need for complexity or computational resources. The drawback is that the beam gets warped as shown in FIG. 11, if not pointing perpendicular to the array axis, which however is unimportant in many use cases. Warping refers to a non-symmetrical beam around its look direction as shown in FIG. 12.

The microphone system according to the invention comprises another technique to further improve the performance of the created beam. Typically an array microphone either uses a DSB, FIB or MVDR beamformer. The invention combines the benefits of a FIB and MVDR solution by crossfading both. When crossfading between an MVDR solution, used for low frequencies and a FIB, used for high frequencies, the better low frequency directivity of the MVDR can be combined with the more consistent beam pattern at higher frequencies of the FIB. Using a Linkwitz-Riley crossover filter, as known e.g. from loudspeaker crossovers, maintains magnitude response. The crossfade can be implicitly done in the FIR coefficients without computing both beams individually and afterwards crossfading them. Thus only one set of filters has to be calculated.

Due to several reasons, the frequency response of a typical beam will, in practice, not be consistent over all possible look directions. This leads to undesired changes in the sound characteristics. To avoid this the invented microphone system comprises a steering dependent output equalizer 2460 that compensates for frequency response deviations of the steered beam as depicted in FIG. 11. If the differing frequency responses of certain look directions are known by measurement, simulation or calculation, a look direction dependent output equalizer, inverse to the individual frequency response, will provide a flat frequency response at the output, independent of the look direction. This output equalizer can further be used to adjust the overall frequency response of the microphone system to preference.

Figure 12:
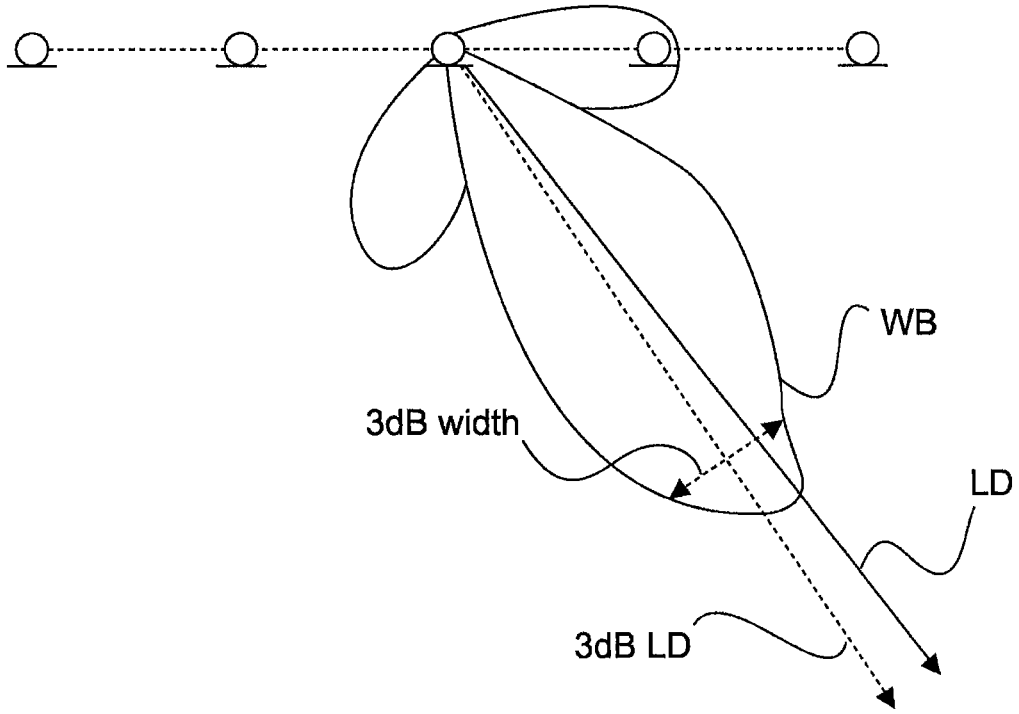
FIG. 12 shows a representation of a warped beam WB according to the invention.

Due to warping of the beam, depending on the steering angle, the beam can be asymmetric around its look direction (see FIG. 12). In certain applications it can thus be beneficial to not directly define a look direction where the beam is pointed at and an aperture width, but to specify a threshold and a beamwidth, while the look direction and aperture are calculated so that the beam pattern is above the threshold for the given beamwidth. Preferably the −3 dB width would be specified, which is the width of the beam, where its sensitivity is 3 dB lower than at its peak position.

The microphone system according to the invention allows for predominant sound acquisition of the desired audio source, e.g. a person talking, utilizing microphone array signal processing. In certain environments like very large rooms and thus very long distances of the source location to the microphone system or very reverberant situations, it might be desirable to have even better sound pickup. Therefore it is possible to combine more than one of the microphone systems in order to form a multitude of microphone arrays. Preferably each microphone is calculating a single beam and an automixer selects one or mixes several beams to form the output signal. An automixer is available in most conference system processing units and provides the simplest solution to combine multiple arrays. Other techniques to combine the signal of a multitude of microphone arrays are possible as well. For example the signal of several line and or planar arrays could be summed. Also different frequency bands could be taken from different arrays to form the output signal (volumetric beamforming).

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claim.

The invention claimed is:

1. A conference system, comprising: a microphone array unit comprising: a plurality of microphone capsules arranged in or on a board mountable on or in a ceiling of a conference room; and a steerable beam; and a processing unit configured to detect a position of an audio source based on output signals of the microphone array unit; wherein the processing unit comprises: a direction recognition unit configured to identify a direction of an audio source and to output a direction signal; a plurality of filters configured to filter the output signals of the microphone array unit; a plurality of delay units configured to individually add an adjustable delay to the outputs of the plurality of filters; a summing unit configured to sum the outputs of the delay units; a frequency response correction filter configured to receive the output of the summing unit and configured to output an overall output signal of the processing unit; and a delay control unit configured to receive the direction signal; wherein the delay control unit is configured to convert directional information from the direction signal into delay values; and wherein the delay units are configured to receive the delay values and to adjust their delay time accordingly.

2. The conference system according to claim 1; wherein the processing unit further comprises a correction control unit configured to receive the direction signal from the direction recognition unit and to convert the direction information into a correction control signal used to adjust the frequency response correction filter; wherein the frequency response correction filter is configured to perform adjustable equalizing; wherein the equalizing is adjusted based on a dependency of the frequency response of the audio source to the direction of the steerable beam; and wherein the frequency response correction filter has an inverted amplitude frequency response and is configured to compensate deviations from a desired amplitude frequency.

3. A conference system comprising: a microphone array unit comprising a plurality of microphone capsules arranged in or on a board mountable on or in a ceiling of a conference room; a steerable beam; and a processing unit configured to detect a position of an audio source based on output signals of the microphone array unit; wherein the processing unit comprises: a direction recognition unit configured to identify a direction of an audio source and to output a direction signal; a plurality of filters configured to filter the output signals of the microphone array unit; a plurality of delay units configured to individually add an adjustable delay to the outputs of the plurality of filters; a summing unit configured to sum the outputs of the delay units; and a delay control unit configured to receive the direction signal; wherein the delay control unit is configured to convert directional information from the direction signal into delay values; and wherein the delay units are configured to receive the delay values and to adjust their delay time accordingly.

4. The conference system according to claim 3, wherein the processing unit is further configured to steer the steerable beam of the microphone array.

5. A conference system comprising: a microphone array unit comprising a plurality of microphone capsules arranged in or on a board mountable on or in a ceiling of a conference room; and a processing unit configured to detect a position of an audio source based on output signals of the microphone array unit; wherein the processing unit comprises: a direction recognition unit configured to identify a direction of an audio source and to output a direction signal; a plurality of filters configured to filter the output signals of the microphone array unit; a plurality of delay units configured to individually add an adjustable delay to the outputs of the plurality of filters; a summing unit configured to sum the outputs of the delay units; and a delay control unit configured to receive the direction signal; wherein the delay control unit is configured to convert directional information from the direction signal into delay values; and wherein the delay units are configured to receive the delay values and to adjust their delay time accordingly; and wherein the processing unit executes an audio beam forming for predominantly acquiring sound coming from a direction as identified by the direction recognition unit.

* * * * *